US010513363B2

(12) United States Patent
Kira et al.

(10) Patent No.: US 10,513,363 B2
(45) Date of Patent: Dec. 24, 2019

(54) RESIN CONTAINER

(71) Applicant: SUNTORY HOLDINGS LIMITED, Osaka (JP)

(72) Inventors: Go Kira, Tokyo (JP); Daisuke Kikuchi, Tokyo (JP)

(73) Assignee: SUNTORY HOLDINGS LIMITED, Osaka (JP)

( * ) Notice: Subject to any disclaimer, the term of this patent is extended or adjusted under 35 U.S.C. 154(b) by 132 days.

(21) Appl. No.: 14/648,966

(22) PCT Filed: Nov. 25, 2013

(86) PCT No.: PCT/JP2013/081643

§ 371 (c)(1),
(2) Date: Jun. 2, 2015

(87) PCT Pub. No.: WO2014/087866

PCT Pub. Date: Jun. 12, 2014

(65) Prior Publication Data

US 2015/0314906 A1 Nov. 5, 2015

(30) Foreign Application Priority Data

Dec. 3, 2012 (JP) ..... 2012-264606

(51) Int. Cl.
*B65D 1/02* (2006.01)

(52) U.S. Cl.
CPC .... *B65D 1/0207* (2013.01); *B65D 2501/0081* (2013.01)

(58) Field of Classification Search
CPC ..... B65D 1/0223; B65D 2501/0036; B65D 2501/0054; B65D 2501/0081
See application file for complete search history.

(56) References Cited

U.S. PATENT DOCUMENTS 4,372,455 A * 2/1983 Cochran ..... B29C 49/0073 215/385
7,044,325 B2 * 5/2006 Przytulla ..... B65D 1/42 220/672

(Continued)

FOREIGN PATENT DOCUMENTS

CN 102556461 7/2012
CN 102596731 7/2012

(Continued)

OTHER PUBLICATIONS

International Search Report in PCT/JP2013/081643, dated Feb. 25, 2014.

(Continued)

*Primary Examiner* — Andrew T Kirsch
(74) *Attorney, Agent, or Firm* — Greenblum & Bernstein, P.L.C.

(57) ABSTRACT

A container formed of resin includes a body portion having an approximately square cross-sectional shape, and a vertically elastically deformable cushion portion provided downwardly of a vertical center of the body portion, the cushion portion having along its entire circumference a groove which is formed progressively wider radially outwards. The container further includes an arcuate portion provided at a corner portion in a cross-sectional shape of the groove.

4 Claims, 7 Drawing Sheets

(56) References Cited

U.S. PATENT DOCUMENTS

| | | | | |
|---|---|---|---|---|
| 7,552,834 | B2 * | 6/2009 | Tanaka | B65D 1/0223 215/381 |
| 8,104,632 | B2 | 1/2012 | Sasaki et al. | |
| 2010/0163515 | A1 | 7/2010 | Nemoto | |
| 2010/0230378 | A1 * | 9/2010 | Colloud | B65D 1/0223 215/384 |
| 2011/0186538 | A1 * | 8/2011 | Strasser | B65D 1/0223 215/381 |

FOREIGN PATENT DOCUMENTS

| | | |
|---|---|---|
| EP | 437620 | 7/1991 |
| EP | 2 653 400 | 10/2013 |
| JP | 62-052034 | 3/1987 |
| JP | 02-117310 | 9/1990 |
| JP | 5-75113 | 10/1993 |
| JP | 06-76012 | 10/1994 |
| JP | 7-040953 | 2/1995 |
| JP | 7-300122 | 11/1995 |
| JP | 10-218148 | 8/1998 |
| JP | 2002-059913 | 2/2002 |
| JP | 2007-039040 | 2/2007 |
| JP | 2008-13180 | 1/2008 |
| JP | 2010-76772 | 4/2010 |
| JP | 2011-105323 | 6/2011 |
| JP | 2012-126449 | 7/2012 |
| WO | 2012/081627 | 6/2014 |

OTHER PUBLICATIONS

IPRP in PCT/JP2013/081643, Jun. 9, 2015.
U.S. Appl. No. 14/648,976 to Go Kira et al., filed Jun. 2, 2015.
New Zealand Office Action in NZ 708482, dated Jan. 17, 2017.
Extended EP Search Report in EP 13860535.7, dated Jun. 23, 2016.
Chinese Office Action in CN 201310642179.6, dated Sep. 7, 2016.
Office Action issued in Japan Counterpart Patent Appl. No. 2012-264606, dated Apr. 3, 2018.
Office Action issued in Japan Appl. No. 2017-054744, dated May 29, 2018.
Office Action issued in Japan Counterpart Patent Appl. No. 2017-054744, dated Jan. 30, 2018.

* cited by examiner

RESIN CONTAINER

TECHNICAL FIELD

The present invention relates to a container formed of resin including a body portion having an approximately square cross-sectional shape, and a vertically elastically deformable cushion portion provided downwardly of a vertical center of the body portion, the cushion portion having along its entire circumference a groove which is formed progressively wider radially outwards.

BACKGROUND ART

As a container formed of resin, there is known a PET bottle having a configuration disclosed in Patent Document 1 for instance. In this, there are disclosed a constricted portion and a rib which are elastically deformable to absorb a load when such load is applied vertically to the PET bottle, thus preventing collapse of the PET bottle.

On the other hand, in the market, there have been developed resin containers of various shapes in accordance with e.g. customer's tastes, which are divided mainly into cylindrical containers having a circular cross-sectional shape and square-column shaped containers having an approximately square cross-sectional shape.

BACKGROUND ART DOCUMENT

Patent Document

Patent Document 1: Japanese Unexamined Patent Application Publication No. 2008-13180

SUMMARY

Problem to be Solved by Invention

However, in the case of the conventional resin containers having a body portion which has an approximately square cross-sectional shape, despite the formation of the rib, as the cross-sectional shape of this rib is approximately similar to that of the container, i.e. the approximately square shape, in the event of application of a load along the vertical direction, there would occur stress concentration at the corner portions, which may invite deformation or break of the rib. In this respect, there has been room for improvement.

Solution

It is an object of the present invention to prevent deformation or break of a cushion portion capable of absorbing a load applied along a vertical direction, in a container formed of resin and having a body portion having an approximately square cross-sectional shape.

According to a first characterizing feature of a resin container relating to the invention, the container comprises:

a body portion having an approximately square cross-sectional shape;

a vertically elastically deformable cushion portion provided downwardly of a vertical center of the body portion, the cushion portion having along its entire circumference a groove which is formed progressively wider radially outwards; and an arcuate portion provided at a corner portion in a cross-sectional shape of the groove.

[Function and Effect]

In the above-described configuration, an arcuate portion is formed at a corner portion in the cross-sectional shape of the groove of the cushion portion. With this, stress concentration will hardly occur in the groove of the cushion portion in the event of elastic deformation thereof, so that there is no possibility of deformation or break of this groove. Accordingly, when a load is applied thereto along the vertical direction, the cushion portion will be elastically deformed to be able to absorb this load in a more reliable manner.

According to a second characterizing feature, the arcuate portion is provided at each and every one of four corner portions in the cross-sectional shape of the groove of the cushion portion.

[Function and Effect]

In the above-described configuration, with formation of the arcuate portions at the respective four corner portions in the cross-sectional shape of the groove of the cushion portion, stress concentration in the groove of the cushion portion in the event of elastic deformation thereof will occur even less likely.

According to a third characterizing feature of the present invention, all of the four arcuate portions have a same curvature radius and a same arc length.

[Function and Effect]

In the above-described configuration, since all of the four arcuate portions have a same curvature radius and a same arc length, the cross-sectional shape of the groove of the cushion portion will become more similar to a circle. As a result, stress concentration in the groove of the cushion portion in the event of elastic deformation thereof will occur even further less likely.

According to a fourth characterizing feature, the cushion portion includes a small concave portion along the entire circumference of the body portion, the small concave portion being shallower than the groove and provided one each upwardly and downwardly of the groove, respectively.

[Function and Effect]

With the above-described configuration, when a load is applied thereto along the vertical direction, the cushion portion can function even more effectively.

According to a fifth characterizing feature, the arcuate portion has a center of circle located at a center of the cross section of the body portion including this arcuate portion.

[Function and Effect]

With the above-described configuration, it is possible to cause a circle of the arcuate portion forming the groove of the cushion portion to further approximate a true circle, so that the load can be absorbed even more effectively.

According to a sixth characterizing feature, the cross-sectional shape comprises an approximate rectangle.

[Function and Effect]

Especially, in case the cross-sectional shape is an approximate rectangle having long sides and short sides, mere forming of the rib having an approximate rectangular shape approximately similar to the cross-sectional shape in the resin container does not realize a cushion portion capable of coping with application of a vertical load. Rather, greater load absorbing effect can be achieved by forming an arcuate portion in the resin container having a rectangular cross-sectional shape.

EMBODIMENT OF THE INVENTION

Next, there will be explained, with reference to the accompanying drawings, a plastic bottle filled with an amount of liquid such as beverage, as one preferred embodiment of a resin container relating to the present invention.

Embodiment

Firstly, various languages used in this detailed disclosure are defined as follows, respectively.

Figure 1:
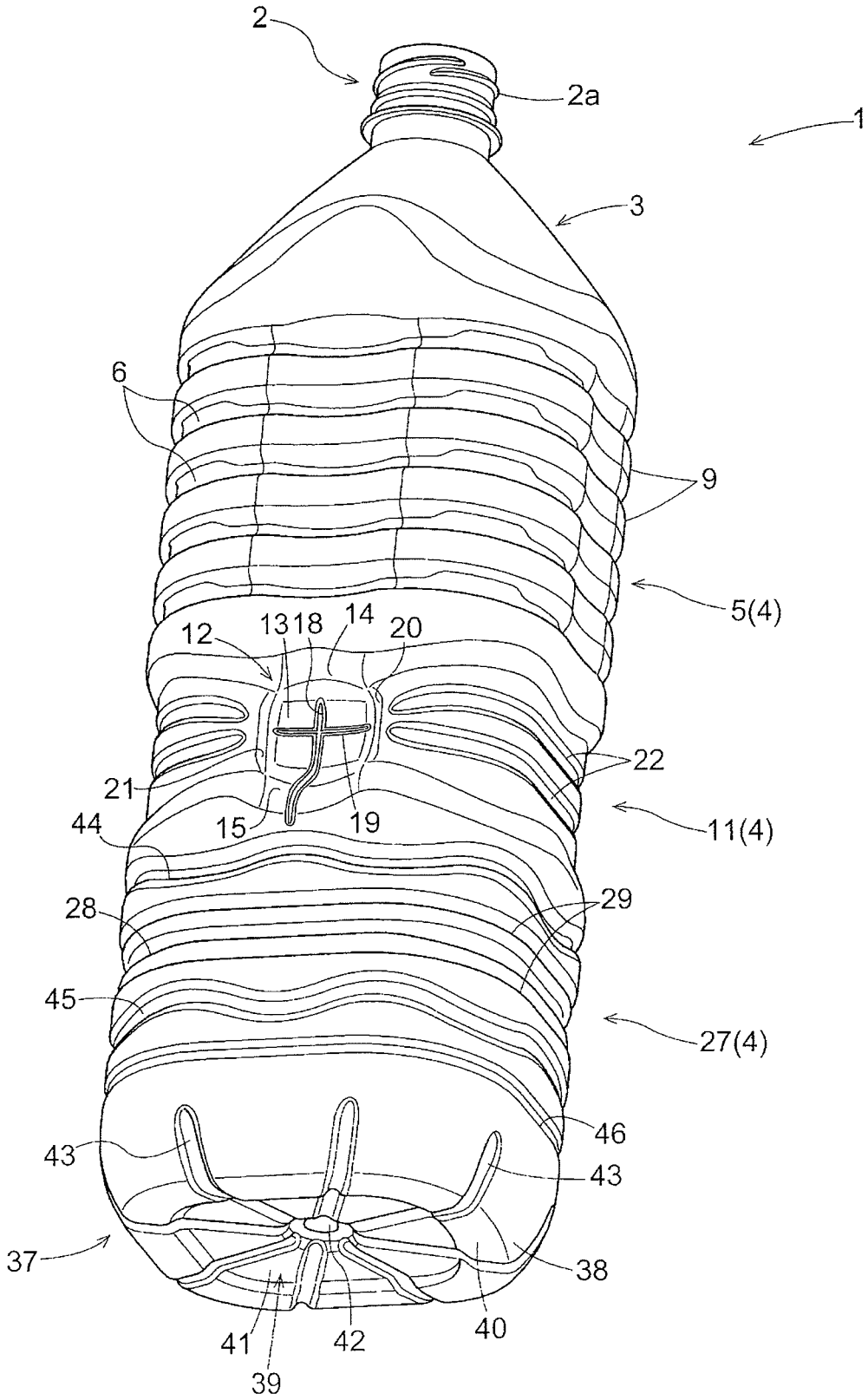
FIG. 1 is a perspective view of a resin container relating to the present invention.
Figure 2:
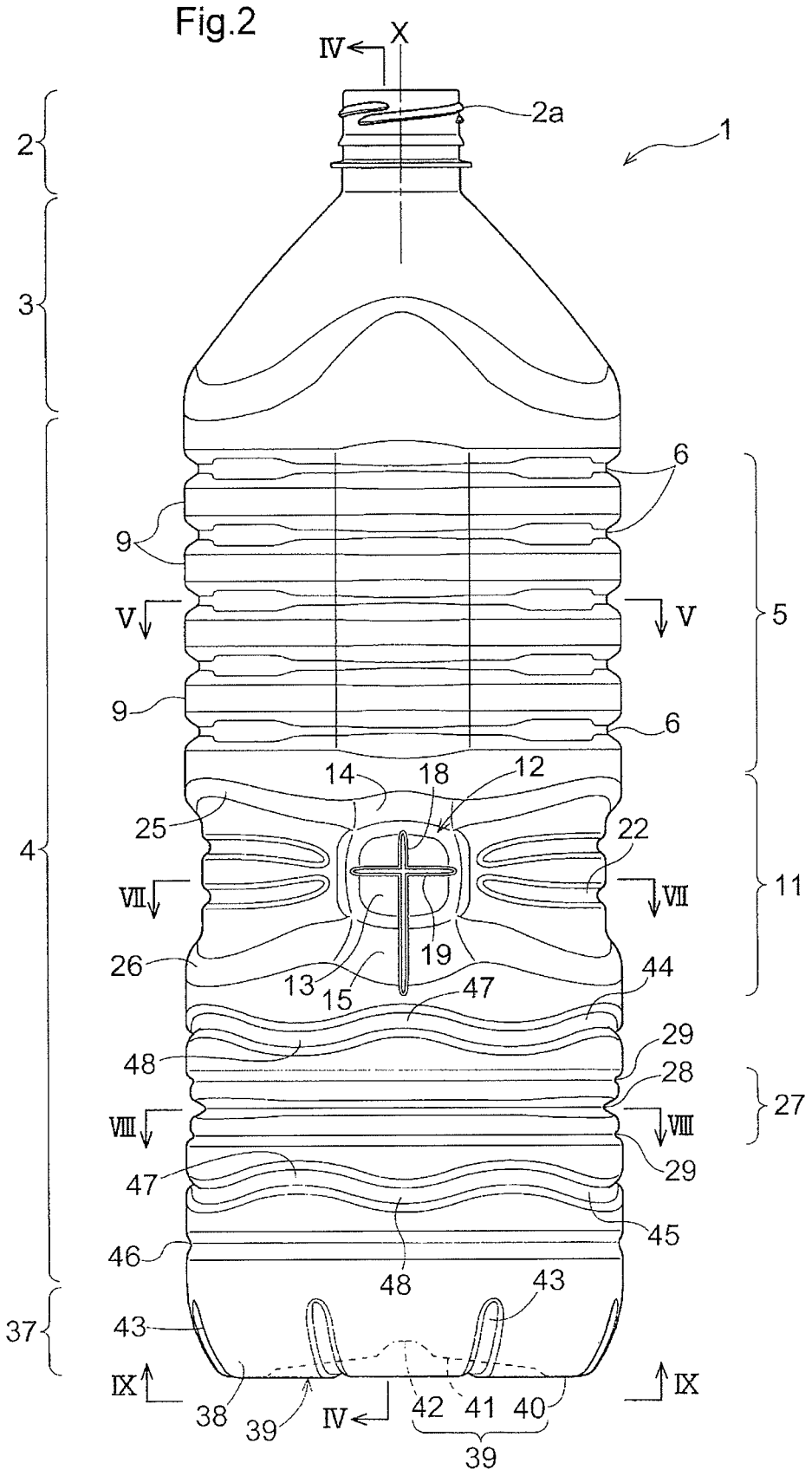
FIG. 2 is a front view showing the resin container relating to the present invention.
Figure 3:
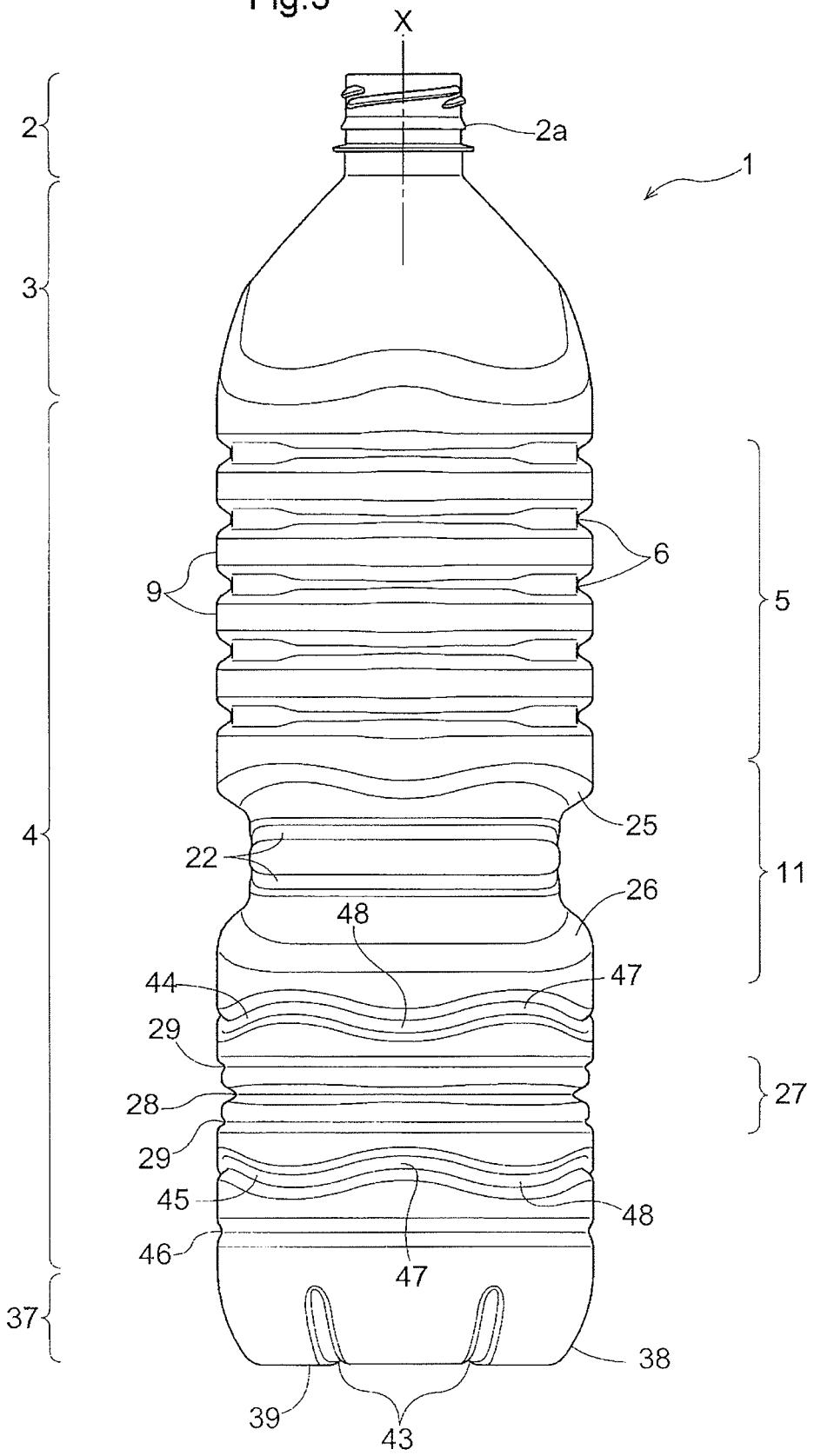
FIG. 3 is a side view showing the resin container relating to the present invention.

A language "vertical direction" as used herein means a direction of a center axis X-X of the plastic bottle 1 shown in FIG. 1 (this will be referred to "bottle 1" for short). In particular, in FIGS. 1-3, the upper side refers to the upper end side in these illustrations and the lower side refers to the lower end side of the same.

A language "lateral direction" or "horizontal direction" means a direction perpendicular to the center axis X-X.

A language "circumferential direction" refers to a direction along the contour of the cross-sectional shape.

A language "radial direction" refers to a radial direction of a circle which centers around a desired point on the center axis X-X.

A language "height" or "width" refers to a length along the center axis X-X.

A language "depth" refers to a length along the radial direction.

A language "cross-sectional shape" refers to a cross-sectional shape of the bottle 1 in a plane (cross-sectional plane) perpendicular to the center axis X-X.

As shown in FIGS. 1-4, the bottle 1 relating to this embodiment includes, in the order from the upper side, a mouth portion 2 to/from which a cap can be attached, a shoulder portion 3 formed continuous from the mouth portion 2, a body portion 4 formed continuous from the shoulder portion 3, and a bottom portion 37 formed continuous from the body portion 4 and disposed at the lowermost part. A space for storing an amount of beverage or the like is formed therein.

The bottle 1 can be manufactured with using a thermoplastic resin such as polyethylene, polypropylene, polyethylene terephthalate, etc. as a principal material thereof, by e.g. a known molding technique such as biaxial orientation blow molding technique.

Incidentally, the bottle 1 can be filled with beverage such as drinking water, tea, juice, coffee, chocolate drink, soft drink, alcoholic drink, milk-based drink, soup, as well as liquid seasoning such as sauce, soy sauce, etc. Further, the inner capacity of the bottle 1 is not particularly limited, but can be variably set, depending on e.g. the kind of liquid to be filled therein, ranging from a relatively small capacity in the unit of a few or several milliliters, a few or several hundreds of milliliters, to a relatively large capacity of a few or several liters, such as a few liters. However, a beverage bottle having a capacity of 1 liter to 2 liters is preferred, for instance.

(Mouth Portion)

As shown in FIGS. 1 through 4, the mouth portion 2 is a portion comprised of a cylindrical portion having an opened upper end and serves as a spout or outlet for beverage or the like. In an outer circumferential face of the mouth portion 2, a male thread portion 2*a* is formed, to which an unillustrated cap can be threadingly and detachably fixed.

(Shoulder Portion)

The shoulder portion 3 is a generally rounded, approximately quadrangular pyramid-like portion whose diameter is progressively increased from the lower end of the mouth portion 2 to the upper end of the body portion 4.

(Body Portion)

The body portion 4 includes, in the order from the upper side, a straight body portion 5, a constricted portion 11, and a cushion portion 27.

Figure 7:
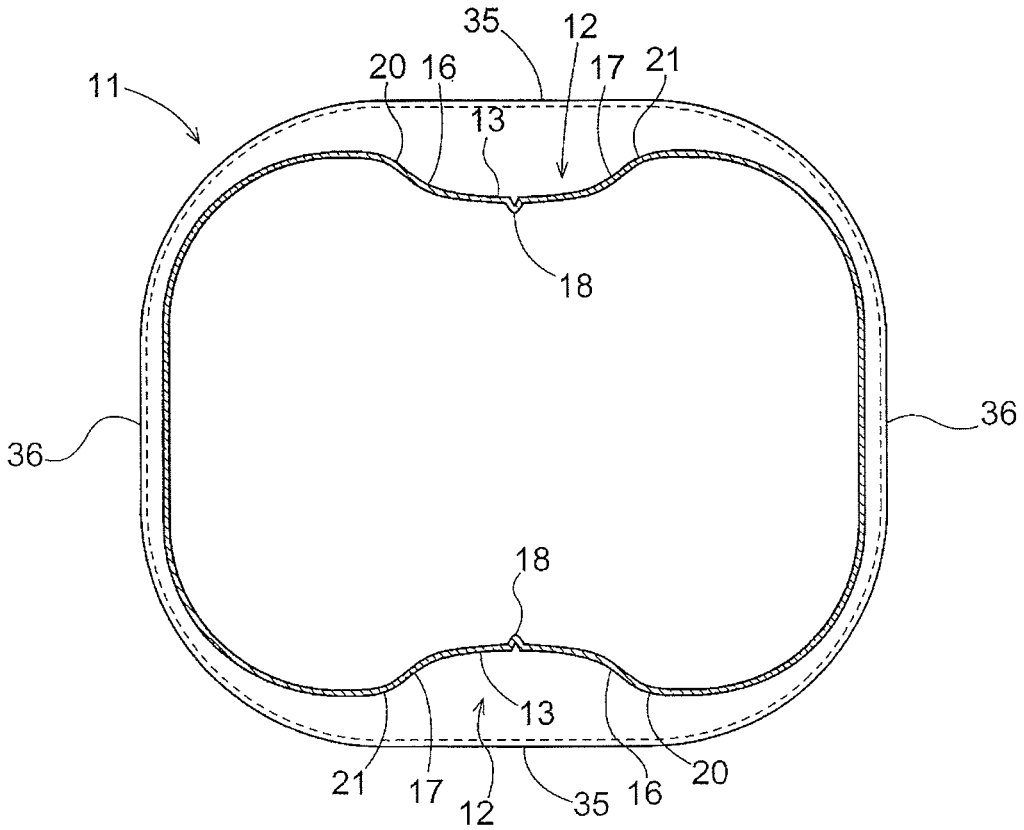
FIG. 7 is a horizontal section along a line VII-VII in FIG. 2.

As shown in FIG. 7, the body portion 4 in this embodiment has a generally rounded, approximately rectangular cross-sectional shape. In this cross-sectional shape of the body portion 4, two long sides 35 are disposed in opposition to each other on the side of the front face and on the side of the back face of the bottle 1, and two short sides 36 are disposed in opposition to each other on the side of the right face and on the side of the left face of the bottle 1. And, these long sides 35 and short sides 36 are continuous to/from each other across arcuate shaped four corners.

[Straight Body Portion]

As shown in FIGS. 1 through 4, the straight body portion 5 is a generally rounded, approximately rectangular solid shaped portion, and on its outer circumferential face a label showing a brand, contents, of beverage or the like can be provided. The straight body portion 5 includes a plurality of first grooves 6 formed equidistantly in the vertical direction, with convex portions 9 being formed each adjacent first grooves 6. These first grooves 6 and the convex portions 9 are provided along the entire circumference of the straight body portion 5 and have a function as reinforcing ribs for increasing the lateral strength of the bottle 1.

Figure 5:
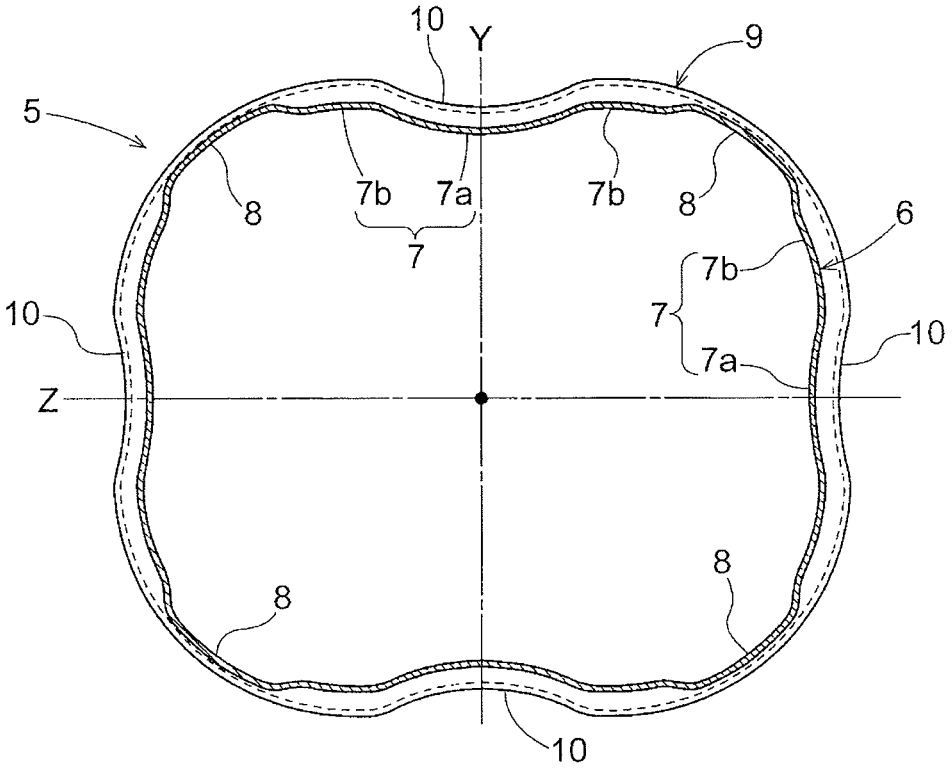
FIG. 5 is a horizontal section along a line V-V in FIG. 2.

As shown in FIG. 5, the first groove 6 includes, in alternation long the circumferential direction, protruding portions 7 protruding toward the inner side of the straight body portion 5 and non-protruding portions 8. Therefore, the depth of the first groove 6 is not constant along the entire circumference of the straight body portion 5, but varies in undulation.

The protruding portions 7 includes a first protruding portion 7*a* which protrudes to the inner side in the form of a ridge, and a second protruding portion 7*b* whose protrusion amount is smaller than that of the first protruding portion 7*a*. The first protruding portions 7*a* are provided at respective lateral center portions of the front face, the back face, the right face and the left face of the straight body portion 5. The second protruding portions 7*b* are formed in continuation on the left and right opposed sides of the first protruding portions 7*a*. Adjacent second protruding portions 7*b* extend continuous with each other via the non-protruding portion 8 therebetween. The non-protruding portions 8 are provided at the four corners in the cross-sectional shape of the straight body portion 5.

The first protruding portions 7*a*, the second protruding portions 7*b*, and the non-protruding portions 8 are disposed in line symmetry, relative to a symmetry axis formed by a center line Y-Y extending through the lateral centers of the front face and the back face of the straight body portion 5, or relative to a symmetry axis formed by a center line Z-Z extending through the lateral centers of the right face and the left face of the straight body portion 5.

Further, in the convex portions 9 of the straight body portion 5, at the respective lateral center portions of the front face, the back face, the right face and the left face of the straight body portion 5, there are formed dent portions 10 which are recessed with gentle slope toward the inner side of the straight body portions 5. These dent portions 10 are provided at same positions as the first protruding portions 7*a* of the first groove 6 described above, in the vertical direction.

[Constricted Portion]

As shown in FIGS. 1 through 4, the constricted portion 11 is a portion which has a reduced diameter compared with the remaining portion of the body portion 4, in order to facilitate a consumer's gripping of the bottle 1.

Figure 4:
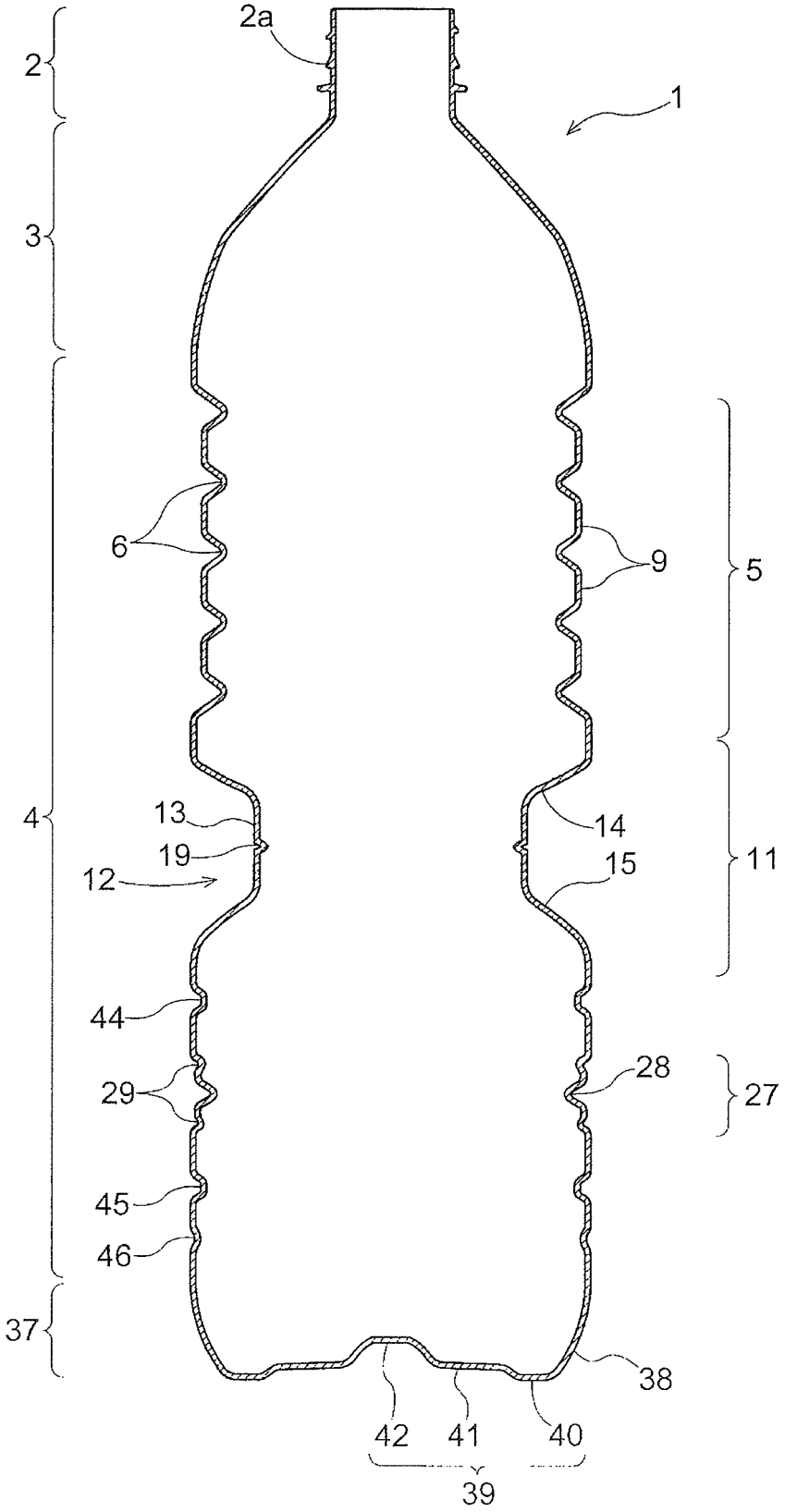
FIG. 4 is a vertical section along a line IV-IV in FIG. 2.

The constricted portion 11 is provided adjacent the vertical center portion of the body portion 4. As shown in FIG. 4, in the front face and the back face of this constricted portion 11 respectively, there are formed concave portions 12 which are largely receded in the form of approximate rectangle. The two concave portions 12 are provided respectively at the lateral center portions of the front face and the back face of the constricted portion 11, in opposition to each other. Therefore, when a consumer grips the bottle 1 by one hand, he/she can grip the bottle 1 in a reliable manner, with placing the thumb on one concave portion 12 and placing the middle finger (or the index finger) on the other concave portion 12.

Figure 6:
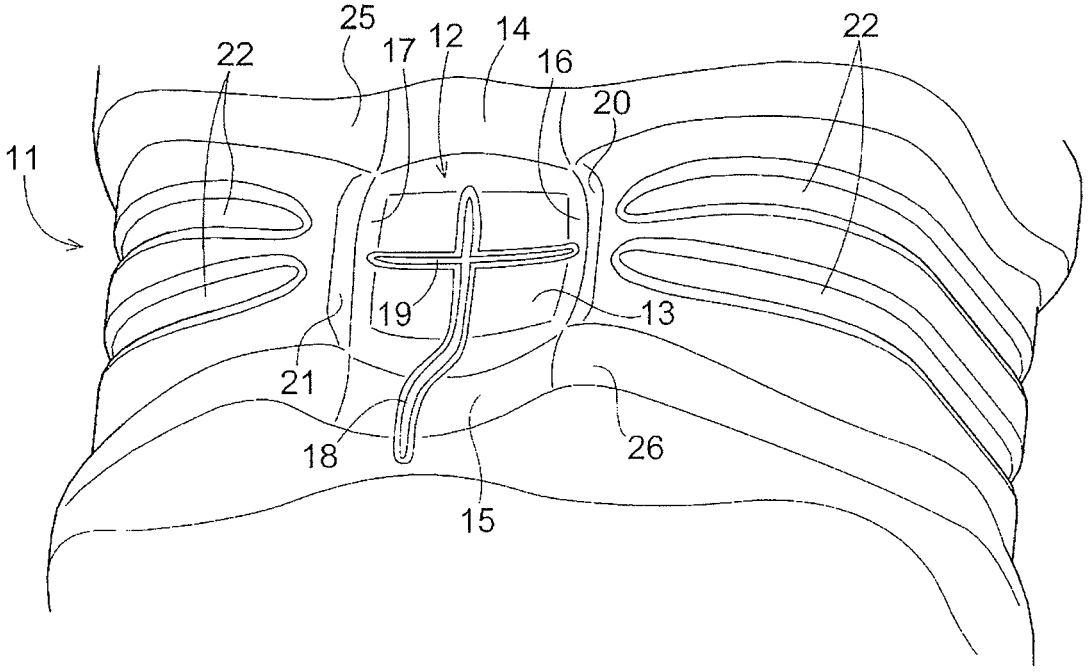
FIG. 6 is an enlarged view showing vicinity of a concave portion in the resin container relating to the present invention.

As shown in FIG. 6, the concave portion 12 includes a bottom face 13, an upper inclined face 14 extending continuous from the upper side of the bottom face 13, a lower inclined face 15 extending continuous from the lower side of the bottom face 13, a right inclined face 16 extending continuous from the right side of the bottom face 13, and a left inclined face 17 extending continuous from the left side of the bottom face 13.

The upper inclined face 14 and the lower inclined face 15 are inclined such that they are positioned closer to each other toward the bottom face 13 side. The right inclined face 16 and the left inclined face 17 are inclined such that they are positioned closer to each other toward the bottom face 13 side.

The inclination of the right inclined face 16 is substantially same as the inclination of the left inclined face 17. Whereas, the inclination of the lower inclined face 15 is set smaller/gentler than the inclination of the upper inclined face 14.

The concave portion 12 further includes a vertical groove 18 extending from the bottom face 13 to the lower inclined face 15. Further, in the bottom face 13 of the concave portion 12, there is provided a lateral groove 19 extending in the lateral direction.

On the right side and left side of the concave portion 12 respectively, there are provided a right vertical ridge portion 20 and a left vertical ridge portion 21 which extend in the vertical direction. The right vertical ridge portion 20 extends continuously with the right inclined face 16 of the concave portion 12, and the left vertical ridge portion 21 extends continuously with the left inclined face 17 of the concave portion 12. The right vertical ridge portion 20 and the left vertical ridge portion 21 are disposed in parallel with each other.

Two circumferential grooves 22 juxtaposed in the vertical direction extend respectively from the right vertical ridge portion 20 and the left vertical ridge portion 21 of the front face to the left vertical ridge portion 21 and the right vertical ridge portion 20 of the back face, respectively. Incidentally, the depths of these circumferential grooves 22 are same and constant along the entireties thereof. As shown in FIG. 1, in this embodiment, the position of the lateral groove 19 of the concave portion 12 in the vertical direction is between the two circumferential grooves 22.

To the upper inclined face 14 of the concave portion 12, an upper wavelike inclined face 25 with a gentle inclination extends, and to the lower inclined face 15 of the concave portion 12, a lower wavelike inclined face 26 with a gentle inclination extends. The upper wavelike inclined face 25 and the lower wavelike inclined face 26 are inclined such that they are positioned closer to each other toward the bottom face 13 side of the concave portion 12. The upper wavelike inclined face 25 presents a wavelike curved face along the entire circumference of the constricted portion 11. Whereas, the lower wavelike inclined face 26 presents wavelike curved faces (see FIG. 2) on the front face side and the back face side of the bottle 1 where the concave portions 12 are formed, but present straight inclined faces (see FIG. 3) on the side face sides of the bottle 1.

Incidentally, as sole requirement for the upper wavelike inclined face 25 and the lower wavelike inclined face 26, these should be wavelike inclined faces at least in the front face and the back face of the bottle 1 where the concave portions 12 are formed. These can be e.g. straight inclined faces on the lateral faces, or can present wavelike curves along the entire circumference thereof. The wavelike curve arrangement is advantageous for dispersing stress more effectively, so that deformation of the container when a load is applied thereto can be restricted.

[Cushion Portion]

As shown in FIGS. 1 through 4, the cushion portion 27 is provided lower than the vertical center of the body portion 4. The cushion portion 27 comprises a bellows-like portion including a V-shaped concave portion 28 in the form of a groove having a V-shaped vertical cross-section and formed progressively wider radially outwards and two small concave portions 29, 29 provided upwardly and downwardly of the V-shaped concave portion 28, respectively and has a line symmetrical configuration relative to the V-shaped concave portion 28 as its axis of symmetry.

Figure 8:
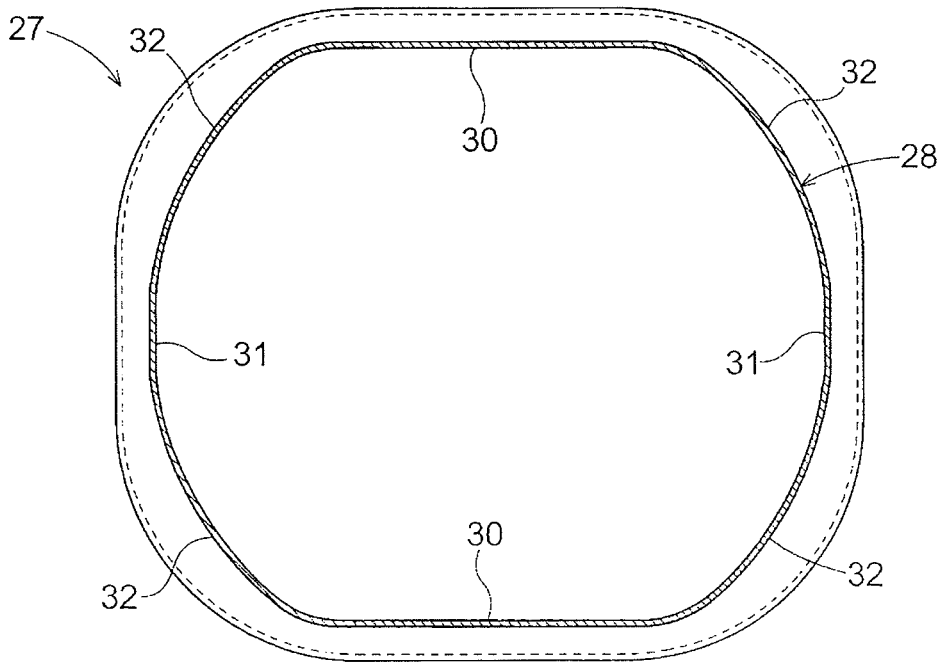
FIG. 8 is a horizontal section along a line VIII-VIII in FIG. 2.

As shown in FIG. 8, at each and every one of the four corners in the cross-sectional shape of the V-shaped concave portion 28, an arcuate portion 32 is formed. In the case of the cross-sectional shape of the V-shaped concave portion 28 in the instant embodiment, two long side portions 30 are disposed in opposition on the front face side and the back face side of the bottle 1, whereas two short side portions 31 are disposed in opposition on the right face side and left face side of the bottle 1, respectively. And, these long side portions 30 and short side portions 31 are continuous with each other via the four arcuate portions 32. Further, these four arcuate portions 32 all have a same curvature radius and a same arcuate length. Moreover, the center of a circle forming the arcuate portions 32 is located at the center of the cross-sectional shape of the bottle 1 including the arcuate portions 32.

In the instant embodiment, the arcuate portion 32 is formed at each one of the four corner portions in the cross-sectional shape of the V-shaped concave portion 28. However, it will suffice if the arcuate portion 32 is formed at least in one of the four corner portions.

Further, though not shown, the cross-sectional shape of the V-shaped concave portion 28 is not limited to the above-described shape, but can omit the two short side portions 31. In this case, the two arcuate portions 32 disposed on the right side will be continuous with each other and also the two arcuate portions 32 disposed on the left side will be continuous with each other, so that the cross-sectional shape of the V-shaped concave portion 28 as a whole will present a shape like an athletic track field.

As shown in FIG. 4, the cushion portion 27, due to the presence of the three grooves, i.e. the V-shaped concave portion 28 and the two small concave portions 29, 29, has a three-staged (deck) spring structure, which allows elastic deformation of this portion 27 in the vertical direction. Therefore, even if a load is applied to the bottle 1 in the vertical direction, this load can be effectively absorbed through elastic deformation of the cushion portion 27, whereby collapse of the bottle 1 can be prevented. Further, as the arcuate portion 32 is formed at each one of the four corners in the cross-sectional shape of the V-shaped concave portion 28, the possibility of occurrence of stress concentration in the V-shaped concave portion 28 at the time of elastic deformation is less, and there is no possibility of deformation or break of the V-shaped concave portion 28. Therefore, even if a load is applied to the bottle 1 in the vertical direction, this load can be absorbed in a reliable matter through elastic deformation of the cushion portion 27.

Incidentally, the cushion portion 27 in this embodiment includes the three grooves, i.e. the V-shaped concave portion 28 and the two small concave portions 29, 29, as grooves extending along its entire circumference. However, the invention is not limited thereto. Alternatively, the cushion portion 27 can include one V-shaped concave portion 28 alone or a plurality thereof, or can include one or more small concave portions 29 upwardly and downwardly of the V-shaped concave portion 28 respectively or can include a plurality of V-shaped concave portions 28 and one or more small concave portions 29, and so on.

(Bottom Portion)

As shown in FIGS. 1 through 4, the bottom portion 37 includes a circumferential wall 38 and a bottom wall 39.

The circumferential wall 38 is a portion which extends from the circumferential edge of the bottom wall 39 having a generally rounded, approximately rectangular shape and becoming wider upwards. The bottom wall 39 includes a contact portion 40 formed along its edge, a rising portion 41 rising gently from the inner edge of the contact portion 40 toward the center of the bottom wall 39, and a circular dent 42 formed at the center of the rising portion 41 and protruding upwards. Meanwhile, when the bottle 1 is placed erect on e.g. a flat desk, the contact portion 40 will come into contact with the desk, etc.

Figure 9:
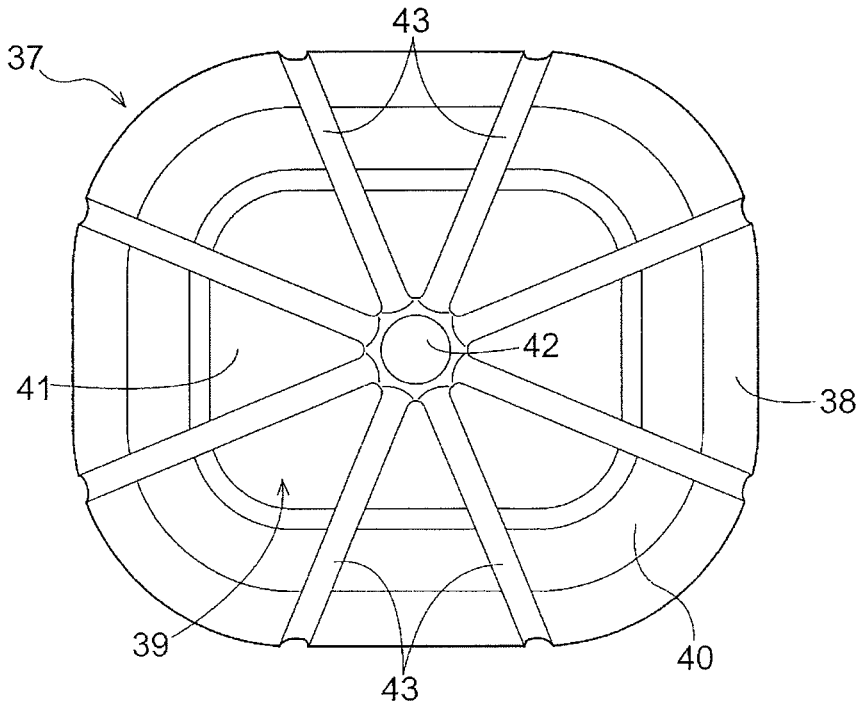
FIG. 9 is a bottom view showing a bottom portion of the resin container relating to the present invention.

As shown in FIG. 9, from the dent 42 of the bottom wall 39, at eight positions equidistant from the dent 42 along the circumferential direction, vertical concave portions 43 are formed as grooves radially extending from the dent 42 of the bottom wall 39 to the circumferential wall 38. These vertical concave portions 43 serve as reinforcing ribs for reinforcing the strength of the bottom portion 37. Further, these vertical concave portions 43 provide another function of allowing cleaning liquid to be distributed uniformly over the entire bottom portion 37 along these vertical concave portions 43 when the inner side of the bottle 1 is to be cleaned after molding thereof, thus improving cleaning performance of the bottom portion 37.

As shown in FIGS. 1 through 4, the bottle 1 according to this embodiment includes a first wavelike circumferential groove 44 in the body portion 4 between the constricted portion 11 and the cushion portion 27, and a second wavelike circumferential groove 45 in the body portion 4 between the cushion portion 27 and the bottom portion 37. Further, at the lower end of the body portion 4 (adjacent the border between the body portion 4 and the bottom portion 37), a lower circumferential groove 46 is provided.

The first wavelike circumferential groove 44 and the second wavelike circumferential groove 45 each is a groove having a constant depth comprising sets of an upper curved portion 47 and a lower curved portion 48 in alternation along the entire circumference of the body portion 4, meandering in a waveform as seen laterally. In the instant embodiment, the first wavelike circumferential groove 44 and the second wavelike circumferential groove 45 are disposed with an offset in the circumferential direction from each other, such that at a position where the upper curved portion 47 of the first wavelike circumferential groove 44 is disposed, the lower curved portion 48 of the second wavelike circumferential groove 45 is disposed. The lower circumferential groove 46 is a groove having a constant depth provided along the entire circumference of the body portion 4. These first wavelike circumferential groove 44, the second wavelike circumferential groove 45, and the lower circumferential groove 46 all have the function as reinforcing rib for reinforcing strength of the lateral face of the bottle 1.

INDUSTRIAL APPLICABILITY

The resin container according to the present invention can be used as a container to be filled with not only such non-carbonated drink such as water, green tea, oolong tea, juice, etc., but also carbonated drink or a food product such as sauce.

DESCRIPTION OF REFERENCE MARKS/NUMERALS

1 bottle
2 mouth portion
2*a* male thread portion
3 shoulder portion
4 body portion
5 straight body portion
6 first groove
7 protruding portions
7*a* first protruding portion
7*b* second protruding portion
8 non-protruding portion
9 convex portion
10 dent
11 constricted portion
12 concave portion
13 bottom face
14 upper inclined face
15 lower inclined face
16 right inclined face
17 left inclined face
18 vertical groove
19 lateral groove
20 right vertical ridge portion
21 left vertical ridge portion
22 circumferential groove
25 upper wavelike inclined face
26 lower wavelike inclined face

27 cushion portion
28 V-shaped concave portion (groove)
29 small concave portion
30 long side portion
31 short side portion
32 arcuate portion
35 long side
36 short side
37 bottom portion
38 circumferential wall
39 bottom wall
40 contact portion
41 rising portion
42 dent
43 vertical concave portion
44 first wavelike circumferential groove
45 second wavelike circumferential groove
46 lower circumferential groove
47 upper curved portion
48 lower curved portion

What is claimed is:

1. A resin container comprising:

a body portion having an approximately square cross-sectional shape;

a vertically elastically deformable cushion portion provided downwardly of a vertical center of the body portion, the cushion portion having along its entire circumference a V-shaped concave groove which is formed progressively wider radially outwards, the V-shaped concave groove defining a spring structure in the cushion portion that allows elastic deformation of the cushion portion in a vertical direction; and an arcuate portion provided at a corner portion in a cross-sectional shape of the V-shaped concave groove, wherein the arcuate portion is provided at each and every one of four corner portions in the cross-sectional shape of the V-shaped concave groove of the cushion portion, wherein each arcuate portion has a circle center located at the center of the cross section of the body portion including the arcuate portions, and wherein the cross-sectional shape of the V-shaped concave groove includes at least one pair of straight segments along which the V-shaped concave groove extends on opposing sides of the resin container.

2. The resin container according to claim 1, wherein all of the four arcuate portions have a same curvature radius and a same arc length.

3. The resin container according to claim 1, wherein the cushion portion includes a small concave portion along the entire circumference of the body portion, the small concave portion being shallower than the V-shaped concave groove and the small concave portion includes a first small concave portion provided above the V-shaped concave groove and a second small concave portion provided below the V-shaped concave groove.

4. The resin container according to claim 1, wherein the cross-sectional shape comprises an approximate rectangle.

* * * * *